US011338971B1

(12) United States Patent
Capper et al.

(10) Patent No.: US 11,338,971 B1
(45) Date of Patent: May 24, 2022

(54) SMART DEVICE BOTTLE CAP

(71) Applicants: David G. Capper, Novato, CA (US); Andrew S. Filo, Cupertino, CA (US)

(72) Inventors: David G. Capper, Novato, CA (US); Andrew S. Filo, Cupertino, CA (US)

(73) Assignee: Appcessories LLC, Novato, CA (US)

( * ) Notice: Subject to any disclaimer, the term of this patent is extended or adjusted under 35 U.S.C. 154(b) by 161 days.

(21) Appl. No.: 16/282,194

(22) Filed: Feb. 21, 2019

Related U.S. Application Data

(60) Provisional application No. 62/633,407, filed on Feb. 21, 2018.

(51) Int. Cl.
*B65D 51/24* (2006.01)
*A47G 19/22* (2006.01)

(52) U.S. Cl.
CPC ..... *B65D 51/24* (2013.01); *A47G 19/2227* (2013.01); *A47G 2019/2244* (2013.01)

(58) Field of Classification Search
CPC ..... B65D 51/24; B65D 55/00; B65D 39/00; B65D 41/00; A47G 19/2227; A47G 19/025; A47G 19/2255; A47G 2019/2244; A47G 23/16; A47B 23/06; A45F 3/16; F16M 13/02; F16M 11/10; H04M 1/04
USPC ..... 215/228
See application file for complete search history.

(56) References Cited

U.S. PATENT DOCUMENTS 5,294,018 A * 3/1994 Boucher ..... A47G 19/2272 215/376
5,358,770 A * 10/1994 Evans ..... B44C 5/00 40/310
6,079,589 A * 6/2000 Matsuyama ..... B65D 47/147 215/306
D614,918 S * 5/2010 Chisholm ..... D7/510
7,954,773 B2 * 6/2011 Carnevali ..... B60N 3/101 248/160
D682,099 S * 5/2013 Blythe ..... D9/443
8,899,590 B1 * 12/2014 Kahn ..... A63B 67/002 273/398
8,925,760 B1 * 1/2015 Baker ..... A47G 19/2266 220/713
D739,853 S * 9/2015 Lee ..... D14/253
D766,886 S * 9/2016 Lee ..... D14/253
D797,556 S * 9/2017 Brown ..... D9/447
10,155,482 B2 * 12/2018 Corso ..... H04B 1/3877
10,352,498 B2 * 7/2019 Rieger ..... F16M 11/14
10,459,487 B2 * 10/2019 Caron ..... H05K 5/0204
10,571,068 B2 * 2/2020 Law ..... F16M 13/00
(Continued)

FOREIGN PATENT DOCUMENTS

CN 103584464 A * 2/2014
CN 20131576344 * 2/2014 ..... A45F 3/16

*Primary Examiner* — Ernesto A Grano
(74) *Attorney, Agent, or Firm* — Haverstock & Owens A Law Corporation

(57) ABSTRACT

A drinkware contains a drinking bottle cap and a container. The drinking bottle cap that contains a support structure configured to support and host one or more smart devices is disclosed. The drinking bottle cap creates a secured stand for smart phones and smart tablets, such that the smart devices coupled with the drinking bottle cap are immobilized by and supported by the supporting structure of the cap. The drinkware can contain electronic components and used as a media content player similar to a music or video player.

15 Claims, 5 Drawing Sheets

(56) References Cited

U.S. PATENT DOCUMENTS

| | | | | |
|---|---|---|---|---|
| 2008/0000992 | A1* | 1/2008 | Mediare | G01K 11/12 235/494 |
| 2008/0149589 | A1* | 6/2008 | Lach | B65D 23/12 215/386 |
| 2010/0237208 | A1* | 9/2010 | Di Lollo | A47J 47/16 248/213.2 |
| 2012/0285907 | A1* | 11/2012 | Emmons | G06F 1/1628 211/26 |
| 2013/0134282 | A1* | 5/2013 | Negretti | F16M 11/041 248/450 |
| 2014/0071598 | A1* | 3/2014 | Carreon | F16M 13/022 361/679.01 |
| 2014/0246431 | A1* | 9/2014 | Lipson | A47G 21/182 220/212 |
| 2014/0263487 | A1* | 9/2014 | Conwell | A45F 3/18 224/148.1 |
| 2016/0065705 | A1* | 3/2016 | Nam | A47G 19/2227 455/575.8 |
| 2016/0081501 | A1* | 3/2016 | Maniatis | A47G 19/2227 426/2 |
| 2017/0013950 | A1* | 1/2017 | Rieger | F16M 11/2092 |
| 2018/0228280 | A1* | 8/2018 | Li | A47B 23/06 |
| 2019/0018452 | A1* | 1/2019 | Caron | H04M 1/04 |
| 2019/0063667 | A1* | 2/2019 | Law | F16M 13/00 |

* cited by examiner

SMART DEVICE BOTTLE CAP

CROSS-REFERENCE TO RELATED APPLICATION(S)

This application claims priority under 35 U.S.C. § 119(e) of the U.S. Provisional Patent Application Ser. No. 62/633,407, filed Feb. 21, 2018 and titled, "SMART DEVICE BOTTLE CAP," which is also hereby incorporated by reference in its entirety for all purposes.

FIELD OF THE INVENTION

The present invention relates to the field of electronic device holders. More specifically, the present invention relates to electronic device holders incorporated drinkware.

BACKGROUND OF THE INVENTION

Smart devices are gaining extreme popularity and have become a necessity for many people in the modern everyday life. The portability of the smart devices makes them very convenient for people to carry and use the smart devices anywhere and everywhere. Nonetheless, smart devices intrinsically lack a stand or support that provides and maintains a comfortable viewing angle. Moreover, many users want to take photographs of themselves with their companions using their smart device. Conventional smart devices lack a stand or support that can hold the smart device at a convenient angle and attitude for capturing such images. Likewise, persons now stream content on their smart devices. Conventional smart devices lack a stand or support that can hold the smart device at a convenient angle and attitude for viewing such content. Many persons choose to carry water for drinking as a healthy choice. Many such persons prefer to carry a reusable, durable water bottle as a green or eco-friendly choice to avoid using disposable plastic water bottles that have become ubiquitous and a blight on the landscape and waterways owing to improper disposal. Chronic diseases due to improper postures of using smart devices have become major concerns in modern medicine. Many users complain about a variety of symptoms, including headaches, hand tremors, and finger discomfort. There are many reports stating that these hand-held smart devices cause discomfort in at least one area of the upper extremities, upper back, or neck. Due to improper support and viewing angles, long-term use of the smart devices causes continuous mechanical stress on the tendons, muscles, and perimetric tissues, which can induce musculoskeletal symptoms of visual display terminal syndrome.

SUMMARY OF THE INVENTION

A drinkware cap (e.g., a drinking bottle cap) for a drinking vessel contains a support structure configured to support and host one or more consumer, portable electronic devices. The consumer, portable electronic devices can be a smart phone, cellular phone with a camera, tablet computer also known collectively as smart devices. The drinkware cap as a supporting structure that forms a stand for smart devices, such that the smart devices mounted on the drinkware cap is supported by the supporting structure of the cap. The drinkware cap is configured to hold the smart device in an attitude such that the center of gravity of the smart device is located over the drinking vessel. In this way, the structures and materials of the drinkware cap coupled with the drinking vessel form a stable support for the smart devices, which prevents the drinkware and the electronic devices from falling whether the drinkware is full, filled at a predetermined level (e.g., 10%, 30%, 20-50%, or 80% of fluids), or empty. In some embodiments, the drinkware cap contains a loop structure, which can be sized or structured as a finger holding hole or lanyard hole for portable transportation.

In an aspect, a drinking vessel comprises a body structured to contain an amount of fluid. The drinkware cap includes a smart device supporting structure on the drinkware. In some embodiments, the body comprises a cap and a fluid container, wherein the portable electronic device supporting structure is on the cap. In the preferred embodiment, the cap including a supporting structure against which the bottom of the smart device is pressed and an upstanding portion against which the smart device is leaned are integrally formed. In some other embodiments, such as for after-market applications, a flexible band which includes the supporting structure is stretchably mounted on the cap. This composite assembly operates in a manner similar to the integrally formed structure of the preferred embodiment. In other embodiments, the upstanding portion of the cap comprises a finger hole having a size and shape configured for user to carry the drinkware.

In another aspect, a method of displaying media content on a drinkware comprises wirelessly coupling a portable electronic device with a signal processing member on the drinkware and playing the media content from the portable electronic device through a video player, audio player, or both on a media displaying member of the drinkware. In some embodiments, the method further comprises physically placing the portable electronic device on the drinkware, such that the drinkware forms a stand for the portable electronic device. In other embodiments, the method comprises providing an amount of energy from a power source located at the drinkware. In some other embodiments, the power source is located at a bottom portion of the drinkware. In some embodiments, the power source provides weight for balancing the weight of the portable electronic device. In some embodiments, the method comprises supporting the portable electronic device by using a supporting structure on a cap of the drinkware. In other embodiments, the supporting structure comprises a loud speaker.

Other features and advantages of the present invention will become apparent after reviewing the detailed description of the embodiments set forth below.

BRIEF DESCRIPTION OF THE DRAWINGS

Embodiments will now be described by way of examples, with reference to the accompanying drawings which are meant to be exemplary and not limiting. For all figures mentioned herein, like numbered elements refer to like elements throughout.

DETAILED DESCRIPTION OF THE PREFERRED EMBODIMENT

Reference is made in detail to the embodiments of the present invention, examples of which are illustrated in the accompanying drawings. While the invention is described in conjunction with the embodiments below, it is understood that they are not intended to limit the invention to these embodiments and examples. On the contrary, the invention is intended to cover alternatives, modifications and equivalents, which can be included within the spirit and scope of the invention as defined by the appended claims. Furthermore, in the following detailed description of the present invention, numerous specific details are set forth in order to more fully illustrate the present invention. However, it is apparent to one of ordinary skill in the prior art having the benefit of this disclosure that the present invention can be practiced without these specific details. In other instances, well-known methods and procedures, components and processes have not been described in detail so as not to unnecessarily obscure aspects of the present invention. It is, of course, appreciated that in the development of any such actual implementation, numerous implementation-specific decisions must be made in order to achieve the developer's specific goals, such as compliance with application and business related constraints, and that these specific goals vary from one implementation to another and from one developer to another. Moreover, it is appreciated that such a development effort can be complex and time-consuming, but is nevertheless a routine undertaking of engineering for those of ordinary skill in the art having the benefit of this disclosure.

Figure 1:
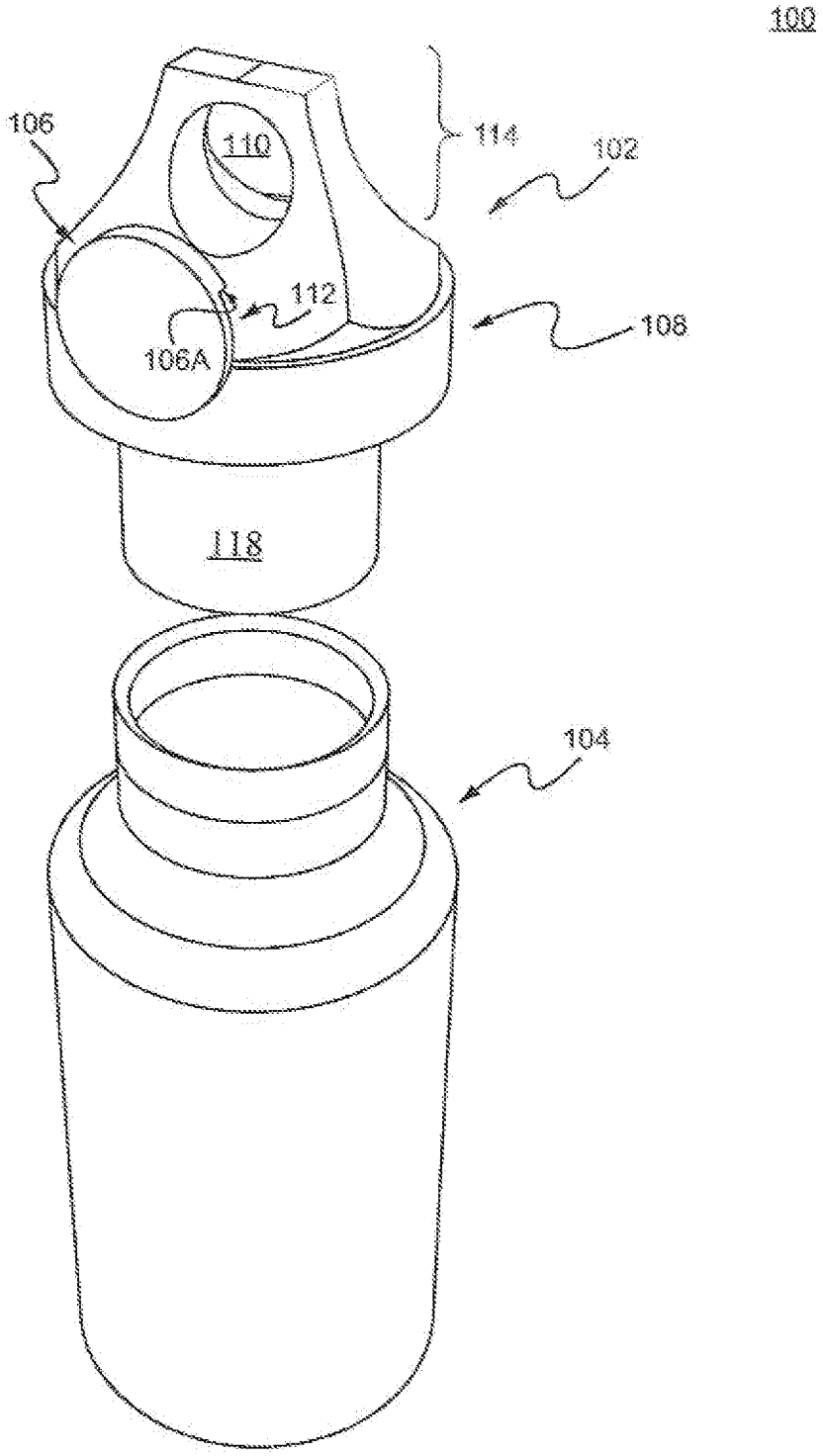
FIG. 1 illustrates a drinkware cap with a drinkware in accordance to some embodiments.

FIG. 1 illustrates a drinkware 100 in accordance to some embodiments. In some embodiments, the drinkware 100 contains a cap 102 with a drinkware bottle 104. In some embodiments, the cap 102 comprises an upstanding portion 114 that is substantially centrally disposed on the cap 102, a loop structure 110, a periphery 108, and a shaft/projection 118 that extends into an opening of the bottle. When inserted into the opening, the shaft/projection 118 helps seal the opening and secures the cap 102 to the bottle 104 along a circumference/surface (e.g., an inner surface) of the opening. The cap 102 includes a supporting structure 106 against which the smart device is held. A void space 112 (e.g., a groove) is formed between the supporting structure 106 and the upstanding portion 114 of the body of the cap 102. In this way, a smart device is inserted into the void space 112 between the supporting structure 106 and the upstanding portion 114. An upper portion of the supporting structure includes an inward facing, hook-like, raised stop 106A. The raised stop projects toward the upstanding portion 114 from the upper portion of the raised stop 106. The raised stop 106A prevents the smart device from sliding upwardly along the supporting structure 106. The smart device is leaned against the upstanding portion 114 and the supporting structure 106 prevents the device from slipping off the cap. The smart device is placed into the void space 112, is captured by the supporting structure 106 and leans against the upraised cap so that the center of gravity of the smart device remains stably over the drinkware.

Figure 2:
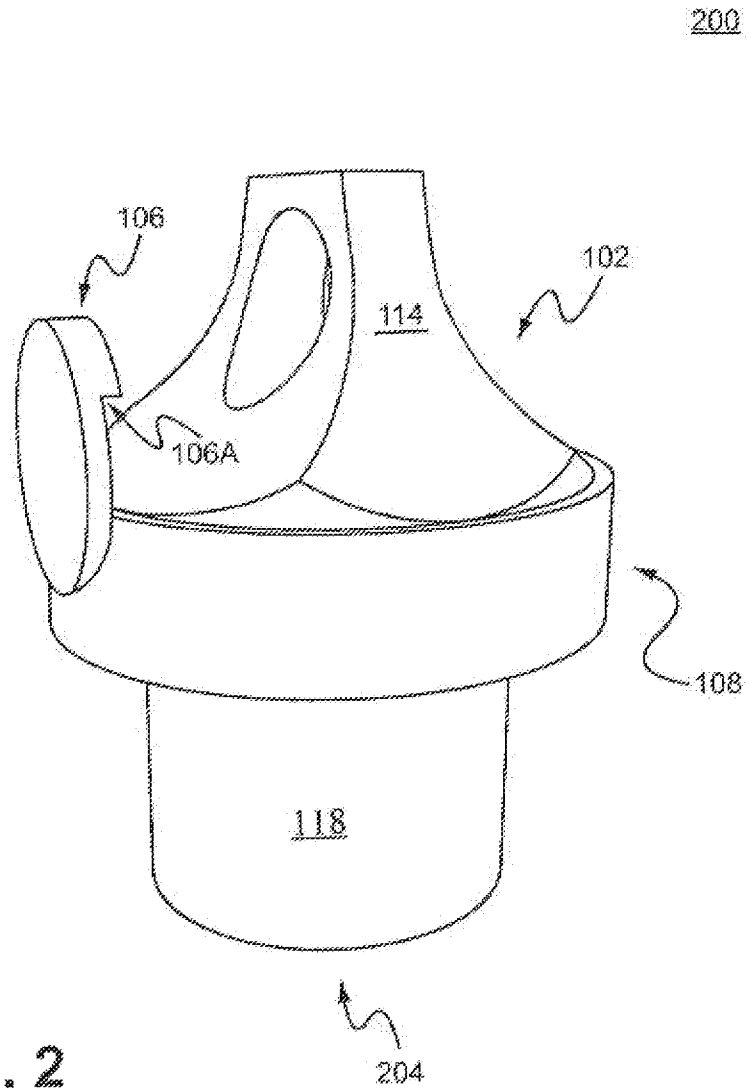
FIG. 2 illustrates a cap structure in accordance with some embodiments.
Figure 2:
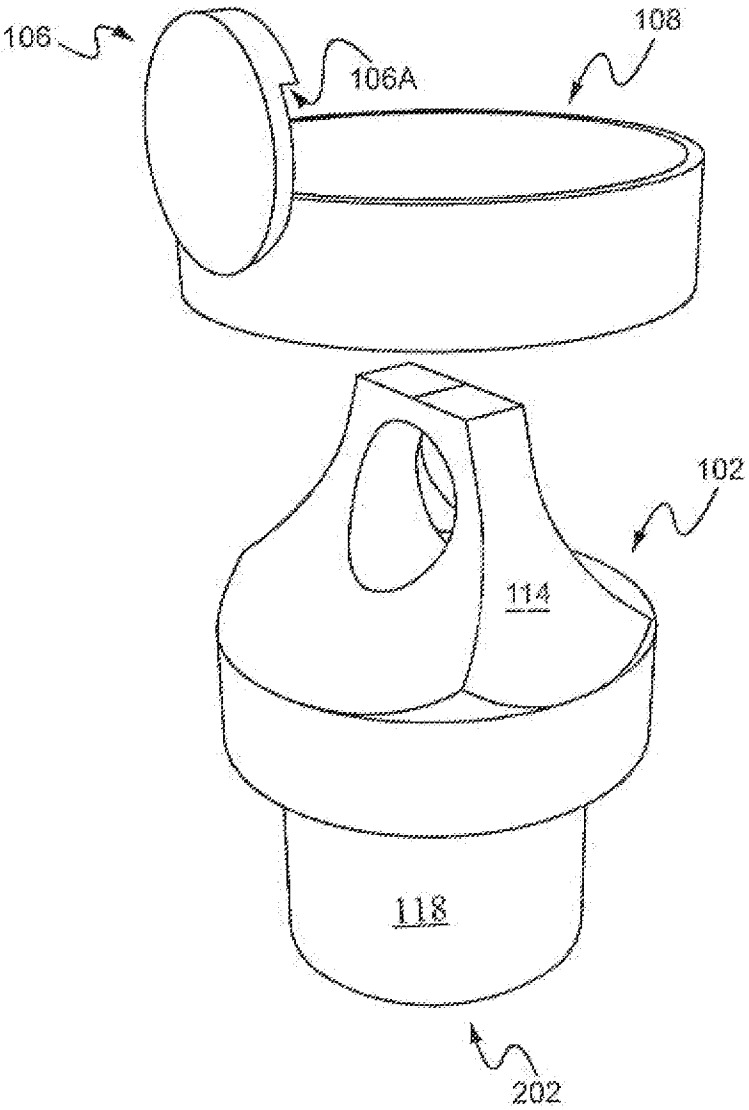

FIG. 2 illustrates an alternative cap structure 200 in accordance with some embodiments. A construction 202 shows a band 116 that is elastically mounted on a body of the cap 102. The band 116 includes the supporting structure 106. A construction 204 shows that the band 116/periphery of the cap 108 is coupled with the body of the cap 102. As shown, the band 116 is stretchably immobilized on the cap with a stretching/elastic force due to the expansion of a body of the band 116. In some embodiments, the supporting structure 106 forms a rigid structure erected or raised in a upright position configured to provide a supporting (e.g., stop a side sliding force). In some embodiments, the supporting structure 106 is structured foldable, so that the supporting structure 106 is able to be folded into the body of the cap 102. In some embodiments, the supporting structure 106 is folded into a recess or cavity of the cap forming a flush surface along a surface of the body of the cap.

Figure 3:
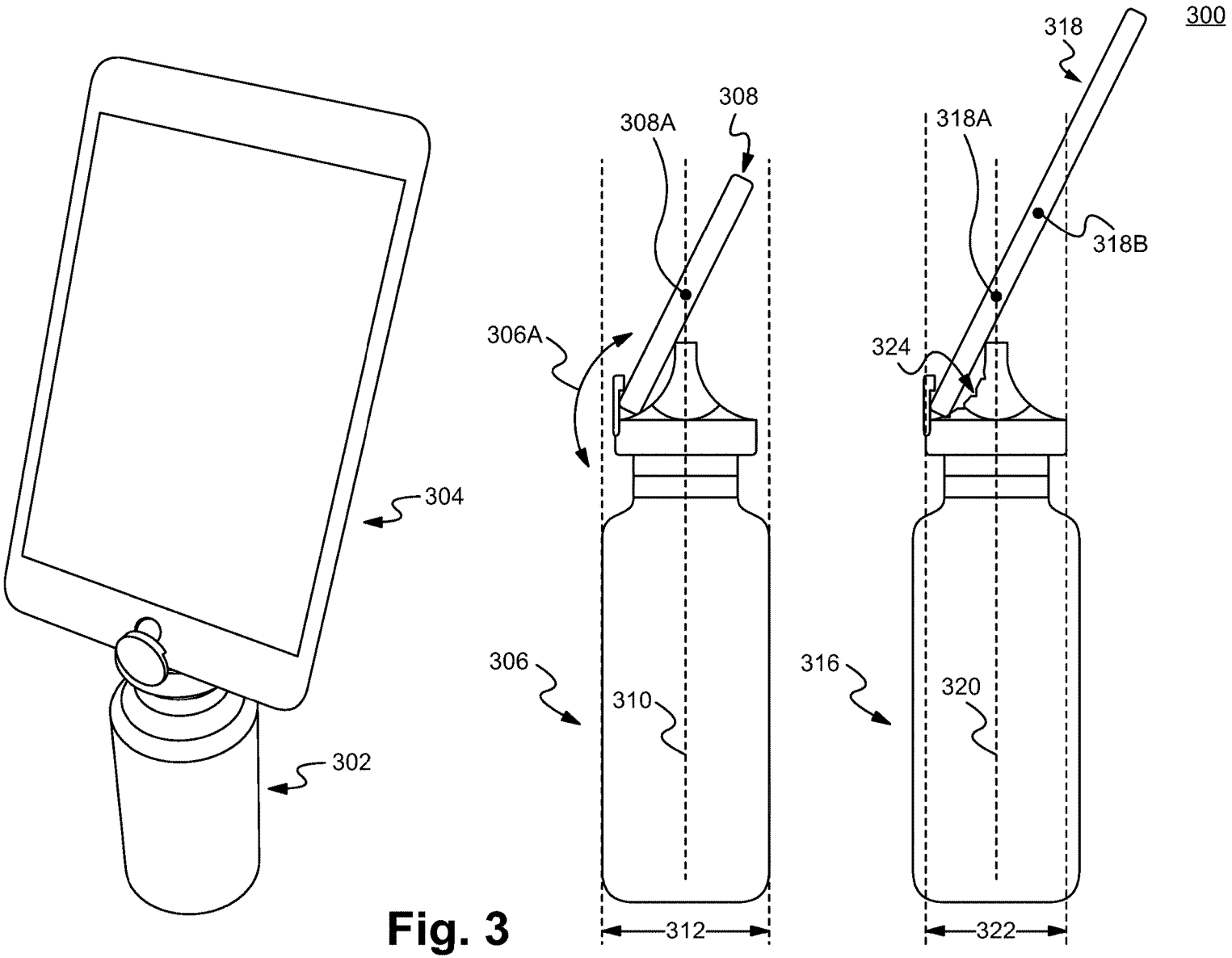
FIG. 3 illustrates a use of the electronic device holder in accordance with some embodiments.

FIG. 3 illustrates a use of the electronic device holder 300 in accordance with some embodiments. As shown, the electronic device 304 is placed on top of a water bottle 302. The supporting structure 106 and the upstanding portion 104 concurrently bracket opposite edges of the electronic device along a depth or thickness of the electronic device. For example, as shown in FIG. 3, the supporting structure 106 engages a first edge of the electronic device 308 along a surface facing a viewer, such as a screen for capturing or viewing content, and the upstanding portion 104 engages an opposite edge of the electronic device 308, such as along a back surface of the electronic device 308. The construction of the water bottle includes a center of gravity 308A of an electronic device 308 at the center line 310 of the bottle 306. The construction is designed to have the center of gravity 308A of the electronic device 308 (e.g., a smart phone, such as IPHONE® and SAMSUNG GALAXY®) fall around the center line of the water bottle 306, which makes a stable structure for holding the electronic device 308. Therefore, the electronic device 308 and the water bottle 306 do not fall sideways or tip over no matter how much water is filled in the bottle, including when the bottle is empty. In some embodiments, the tilt angle 306A of the supporting structure of the cap are made/designed to be adjustable (e.g., adjustable sliding along and able to hold a stable position on the cap), so that the center of gravity 308A of the electronic device is able to be adjusted to be within a range of stable zone 312.

In some embodiments, the cap includes one or more inwardly concave or parabolic recesses 324 on top of the cap, so that the relative hosting position of the electronic device is able to be adjusted to be within a range of stable zones 312 and 322. Similar principles of designing/constructing the structure can be applied to host different sizes and weights of electronic devices, such as touch pads 318 (e.g., IPAD®). As shown, the touch pad 318 has a larger body size than the body of the smart phones disclosed above. The center of gravity 318A of the touch pad 318 is configured/structured to fall at/around the center line 320 of water bottle 316 or within the stable zone 322, which can be within the body covering surface of the water bottle 316. A person of ordinary skill in the art will appreciate that the water bottle 316 can be designed to have various predetermined types of electronic devices' centers of gravity fall anywhere within the range of support (e.g., the stable zone 322 and 312). In some embodiments, the water bottle contains a weighting/heavy object at the bottom of the water bottle 316 to provide a stable balance force for stabling/countering the weight of the electronic devices.

Figure 4:
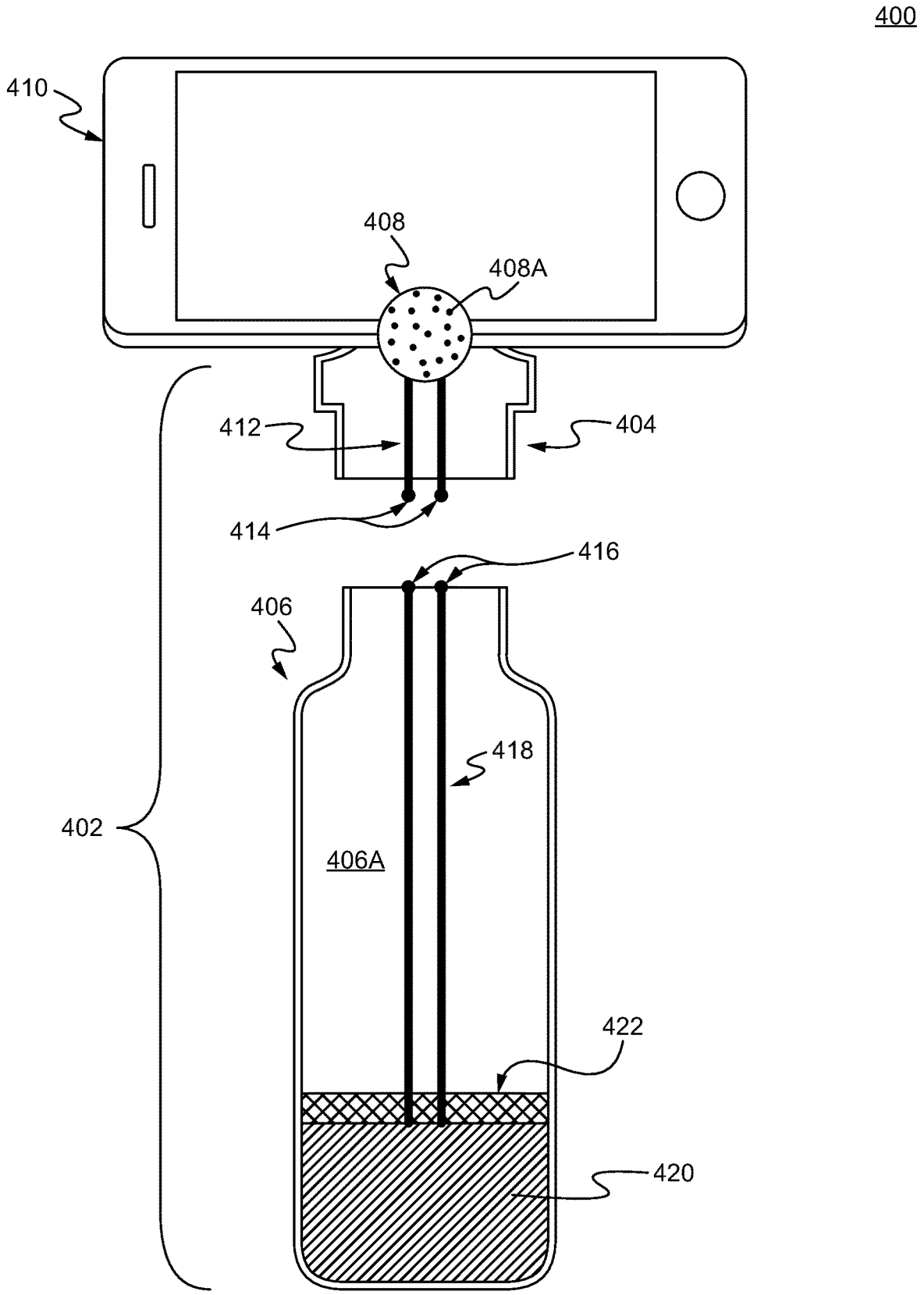
FIG. 4 illustrates a water bottle media display stand in accordance with some embodiments.

FIG. 4 illustrates a water bottle media display stand 400 in accordance with some embodiments. The stand 400 comprises an electronic device holder 408 configured to hold and support an electronic device 410. The stand 400 can comprise a cap portion 404 and a bottle portion 406. In some embodiments, the cap portion 404 comprises the electronic device holder 408, which can be constructed to contain a speaker 408A. Conductive wires 412 at the cap 404 are configured to be conductively coupled with the conductive wire 418 at the bottle portion 406. The conductive coupling of the conductive wire 412 and the conductive wire 418 can be done by coupling the conducting points 414 on the cap portion 404 and the conducting points 416 at the bottle portion 406. The conductive wire 412 and 418 are able to be embedded in the side walls or the body of the stand 400, so that the conductive wires 412 and 418 are invisible, untouchable, or unnoticeable from the surface of the body of the stand 400. Likewise, an optical or sonic means of fluid measurement from the bottom of the cap to the top of the fluid in the bottle can be used to collect fluid level information.

A power source (e.g., rechargeable battery or disposable battery) and/or electronic controlling circuits and units (not shown) are able to be structured/placed at the base 420 of the stand 400. The base 420 functions as a weight for stabilizing, countering, or balancing the weight of the electronic device on the cap portion 404, so that the stand 400 is not tipped over without extreme external forces. In some embodiments, the weight of the base (e.g., position, location, shape of heavier materials such as metal) is designed/constructed to make the center of gravity at the lower half of the stand.

In some embodiments, the base 420, containing batteries, supplies continuous energy to power the speaker 408A and/or transmits electronic signals to the speaker 408A, such that the speaker 408*s* plays predetermined sounds (e.g., music). In some embodiments, an insulation separator 422 is used to separate/isolate the base from the water filling area 406A. In such an example, the insulation separator 422 can be at the bottom of the water bottle, and the stand 400 can function as a standalone water bottle without the base 420.

In some embodiments, the base 420 is constructed to be instantly attachable and/or detachable. For example, the base 420 can contain a screw structure, such that the base can be screwed onto the body of the stand 400. Any other structure that can be used to couple or attach the base 420 to the body of the stand 400 are within the scope of the present disclosure.

Figure 5:
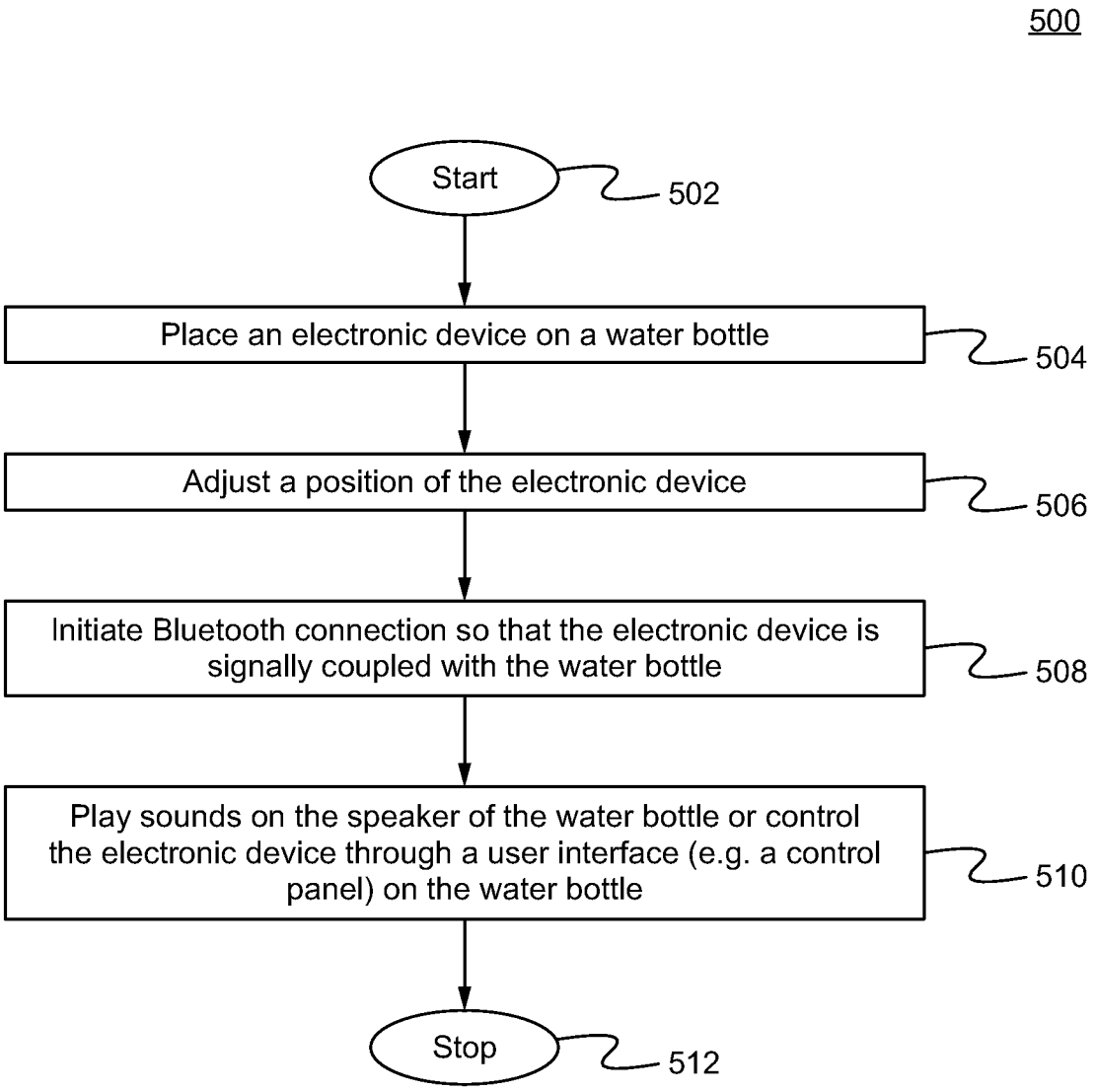
FIG. 5 illustrates an electronic device holding stand using method in accordance with some embodiments.

FIG. 5 illustrates a method 500 of using the electronic device holding stand in accordance with some embodiments. The method can start at a step 502. At a step 504, an electronic device is placed on a water bottle. At a step 506, a position of the electronic device on the stand is adjusted, so that the electronic device is in a balanced position on the stand. At a step 508, Bluetooth connection or any other wireless connection is initiated, so that the electronic device is signally coupled with the electronic components of the water bottle. At a step 510, sounds are played on the speaker of the water bottle and/or the electronic device is controlled through a user interface (e.g., a control panel, such as control buttons) on the water bottle. The method 500 can stop at a step 512.

In operation, the electronic devices are positioned on the water bottle and the relative position of the electronic devices to the water bottle is adjusted for a balanced supporting position.

The present invention has been described in terms of specific embodiments incorporating details to facilitate the understanding of principles of construction and operation of the invention. Such reference herein to specific embodiments and details thereof is not intended to limit the scope of the claims appended hereto. It is readily apparent to one skilled in the art that other various modifications can be made in the embodiment chosen for illustration without departing from the spirit and scope of the invention as defined by the claims. Features in various examples or embodiments are applicable throughout the Present Specification.

What is claimed is:

1. A drinkware comprising:

a vessel structured to contain an amount of fluid and having an opening for drinking; and a cap for sealing the opening having a portable electronic device support, wherein the cap includes an upstanding rest formed in an interior location on the cap, a support formed near a periphery of the cap such that a gap is formed between the upstanding rest and the support for receiving a portable electronic device on the drinkware, and a projection extending into the opening, for securing the cap and the electronic device to the vessel along a circumference of the opening, wherein the upstanding rest and the support are configured to hold the portable electronic device such that opposite edges along a depth of the electronic device are concurrently bracketed and a center of gravity of the portable electronic device is over the vessel.

2. The drinkware of claim 1, wherein the support includes an inward facing raised stop extending from an upper portion of the support toward the upstanding rest.

3. The drinkware of claim 2, wherein the portable electronic device is positioned at an attitude for capturing an image.

4. The drinkware of claim 2, wherein the portable electronic device is positioned at an attitude for displaying content.

5. The drinkware of claim 2, wherein the cap includes the upstanding rest and further comprises a flexible band stretchably immobilized on the cap which incorporates the support.

6. The drinkware of claim 1, wherein the portable electronic device is stably supported even while the body is empty.

7. The drinkware of claim 1, wherein a side cross-section of the upstanding rest is substantially concave.

8. The drinkware of claim 7, wherein a substantially concave surface of the upstanding rest contains vertically stepped recesses configured to engage an edge of the electronic device at different heights over the vessel.

9. The drinkware of claim 8, wherein the recesses are configured so that when an edge of electronic device is engaged by each of the recesses, a center of gravity of the electronic device is within a range of stable zones over the drinkware.

10. The drinkware of claim 1, wherein the upstanding rest is integrally formed with the cap.

11. On a drinkware having a vessel and a cap, a method of supporting an electronic device in an attitude for capturing an image or displaying content, the method comprising:

providing a cap sealing a mouth of a vessel, the cap having an integrally formed substantially centrally disposed upstanding portion, a raised supporting structure positioned substantially at a peripheral edge of the cap and spaced from the upstanding portion, and a projection extending into the mouth; and mounting an electronic device on the drinkware by placing an edge of the electronic device between the supporting structure and leaned against the upstanding portion, wherein the supporting structure includes an inward facing raised stop extending from an upper portion of the supporting structure toward the upstanding portion such that a center of gravity of the electronic device is over the vessel, the projection for securing the cap and the electronic device to the vessel along a circumference of the mouth.

12. The method of claim 11, wherein a bottom of the vessel is weighted.

13. The method of claim 11, wherein the raised stop is adjacent a surface of the electronic device facing a viewer.

14. The drinkware of claim 11, wherein the electronic device is portable.

15. The drinkware of claim 11, wherein the upstanding portion and the raised supporting structure are configured to hold the electronic device such that opposite edges along a depth of the electronic device are concurrently bracketed.

* * * * *